United States Patent [19]

Rammos

[11] Patent Number: 4,614,947

[45] Date of Patent: Sep. 30, 1986

[54] PLANAR HIGH-FREQUENCY ANTENNA HAVING A NETWORK OF FULLY SUSPENDED-SUBSTRATE MICROSTRIP TRANSMISSION LINES

[75] Inventor: Emmanuel Rammos, Creteil, France

[73] Assignee: U.S. Philips Corporation, New York, N.Y.

[21] Appl. No.: 601,518

[22] Filed: Apr. 18, 1984

[30] Foreign Application Priority Data

Apr. 22, 1983 [FR] France ..... 83 06650

[51] Int. Cl.[4] ..... H01Q 1/38; H01Q 13/08

[52] U.S. Cl. ..... 343/778; 343/786

[58] Field of Search ..... 343/700 MS File, 767–770, 343/789, 795, 797, 829, 846, 776, 778, 786; 333/116, 238, 246

[56] References Cited

U.S. PATENT DOCUMENTS

| | | | |
|---|---|---|---|
| 2,885,676 | 5/1959 | Baldwin | 343/769 |
| 3,518,688 | 6/1970 | Stayboldt et al. | 343/789 |
| 3,718,935 | 2/1973 | Ranghelli et al. | 343/846 |
| 4,131,894 | 12/1978 | Schiavone | 343/700 MS File |
| 4,150,383 | 4/1979 | Andersson et al. | 343/768 |
| 4,208,660 | 6/1980 | McOwen, Jr. | 343/789 |
| 4,263,598 | 4/1981 | Bellee et al. | 343/770 |
| 4,431,996 | 2/1984 | Milligan | 343/769 |
| 4,486,758 | 12/1984 | de Ronde | 343/700 MS File |

OTHER PUBLICATIONS

Collier, "Microstrip Antenna Array for 12 Ghz TV", *Microwave Journal,* vol. 20, No. 9, Sep. 1977, pp. 67–71.

*Primary Examiner*—Eli Lieberman
*Assistant Examiner*—Michael C. Wimer
*Attorney, Agent, or Firm*—Robert J. Kraus

[57] ABSTRACT

A planar high-frequency antenna having radiating elements for high-frequency signals includes at least two facing conductive plates provided with oppositely-arranged openings which cooperate to form respective cavities. Disposed between each pair of facing plates is a thin dielectric sheet supporting an array of strip conductors of coaxial lines forming suspended-substrate microstrip lines with these plates. Ends of the strip conductors extend into the cavities and form radiating elements. Each thin dielectric sheet is held in place between the facing plates by means of positioning spacers provided on the faces of these plates. The spacers are located in areas where there are no conductors on the dielectric sheet and are sufficiently remote from each other such that at least two cavities and/or lines of the network of strip conductors are located between any two spacers.

7 Claims, 8 Drawing Figures

PLANAR HIGH-FREQUENCY ANTENNA HAVING A NETWORK OF FULLY SUSPENDED-SUBSTRATE MICROSTRIP TRANSMISSION LINES

BACKGROUND OF THE INVENTION

The present invention relates to a planar high-frequency antenna formed by radiating elements for high-frequency signals. The antenna includes at least two conducting plates provided with oppositely-arranged openings. Disposed between each pair of successive plates there is a thin dielectric sheet supporting an array of strip conductors forming suspended-substrate mircostrip lines with these plates. The ends of the strip conductors extend into cavities formed by the openings and serve as radiating elements.

A planar high-frequency antenna comprising an array of such elements is disclosed in French Patent Applications Nos. 81 08 780 (corresponding to U.S. Pat. No. 4,486,758), No. 82 04 252 (corresponding to U.S. Pat. No. 4,527,165) and No. 82 18 700 (corresponding to allowed U.S. Patent Application Ser. No. 548,263 filed on Nov. 3, 1983).

More specifically, an arrangement is described in FIG. 3 of French patent application No. 82 18 700 which enables the positioning of the strip conductors of the transmission lines constituting the supply networks of the antenna. Each of these networks of high-frequency lines in constituted by a printed circuit provided on a thin dielectric sheet serving as a substrate and inserted between two metal plates or metal-plated dielectrics. Each network is arranged such that the ends of the strip conductors of the lines extend into cavities formed by openings in the plates between which the dielectric sheet is disposed, in such manner as to couple the lines and the cavities. These networks of strip conductors are positioned in a corresponding network of slots provided in each of the plates, which form with these strip conductors coaxial transmission lines of the "suspended-substrate-line" (SSL) type.

Arrangements of this type have two disadvantages. On the one hand the manufacturing tolerances of the slots and the tolerances for positioning the strip conductors in the slots are very small. On the other hand, the losses in the lines increase, to a first approximation, in an inverse ratio to the width of the slots.

SUMMARY OF THE INVENTION

It is an object of the invention to provide an arrangement which facilitates positioning of the strip conductors of the lines while obviating the above-described disadvantages.

According to the invention, in an antenna of the general type described above, each thin dielectric sheet is held in place by means of positioning spacers provided on the faces of the plates between which the sheet is disposed. The spacers are arranged opposite to each other on both sides of the respective sheet, and are arranged relative to this sheet in places where there are no conductors. The spacers are located remotely from each other in such manner that at least two cavities and/or strip conductors are located between any two spacers.

In such an arrangement, the manufacturing tolerances of the plates are less severe, the positioning of the printed circuits is less critical and the efficiency of the antenna improves because the losses in the coaxial lines are minimized. This improvement is brought about by providing a network of "completely suspended-substrate microstrip lines". The space between said adjacent pair of plates, in which the network of microstrip lines is suspended, functions as a slot of infinite width having low loss.

According to a first embodiment of the invention, the positioning spacers are manufactured independently of the plates and are thereafter positioned on these plates.

According to a first variation the positioning spacers are an integral part of the plates between which the printed circuit sheets are disposed, and are manufactured in the same manufacturing operation.

According to a second variation, the positioning spacers are preferably distributed regularly because of the recurrent structure of the network of central conductors.

According to a third variation, the dielectric on which the printed circuits are provided which form the networks of strip conductors, has a thickness between 50 and 100 μm which is an adequate thickness to ensure rigidity, while limiting the losses in the coaxial lines which are also proportional to the thickness of the dielectric.

BRIEF DESCRIPTION OF THE DRAWING

Particulars of the invention and embodiments will become more apparent from the following description, which is given by way of example with reference to the accompanying drawing.

FIG. 1*a* is a cross-sectional view along an axis XX' and FIG. 1*b* is a cross-sectional view along an axis YY' perpendicular to XX'.

This same FIG. 3*a* shows also (by means of a dotted line), the variation in decibels per meter (dB/m), of the total attenuation factor $\alpha_T$ of the line, also as a function of the width a of the slot in millimeters (mm).

The Figures are drawn to scale, except for the thickness in the cross-sectional views which are considerably exaggerated.

DESCRIPTION OF THE PREFERRED EMBODIMENT

Figure 1A:
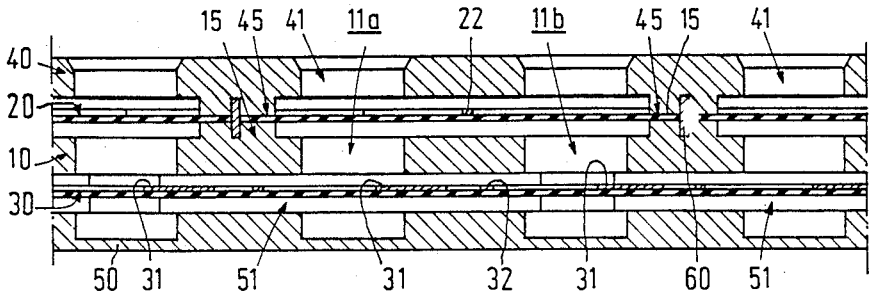
FIGS. 1*a* and 1*b* are cross-sectional views through an antenna comprising two networks of high-frequency lines, realized according to the invention.
Figure 1B:
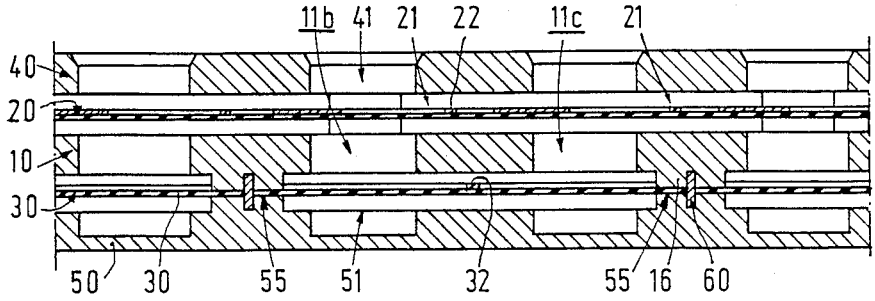

FIGS. 1*a* and 1*b* illustrate a preferred embodiment of the antenna comprising, in succession on opposite sides of an intermediate layer 10 having a plurality of openings 11: (a) a dielectric sheet 20/30 on which a network of microstrip conductors is provided (22 on sheet 20 and 32 on sheet 30); and (b) a further layer 40/50 in which a corresponding plurality of openings are made (41 for layer 40 and 51 for layer 50) placed in line with the openings 11.

The layers 10, 40 and 50 are made of a metallic material or from a metal-plated dielectric. Each network of transmission lines is arranged such that the end (21 for a conductor on sheet 20, and 31 for a conductor on sheet 30) of each printed strip conductor extends into a cavity formed by aligned openings 11 in the layers 10, 40, 50, thus coupling the conductor with a respective cavity and enabling the reception or transmission of high-frequency signals.

The dielectric sheets 20 and 30 are held in position, between the layers 10 and 40 on the one hand and between the layers 10 and 50 on the other hand. The sheets are held by means of a set of positioning spacers 15 and 16 forming part of the layer 10, on both sides thereof, and by means of cooperating spacers 45 and 55 which form part of the layers 40 and 50, respectively.

Figure 2A:
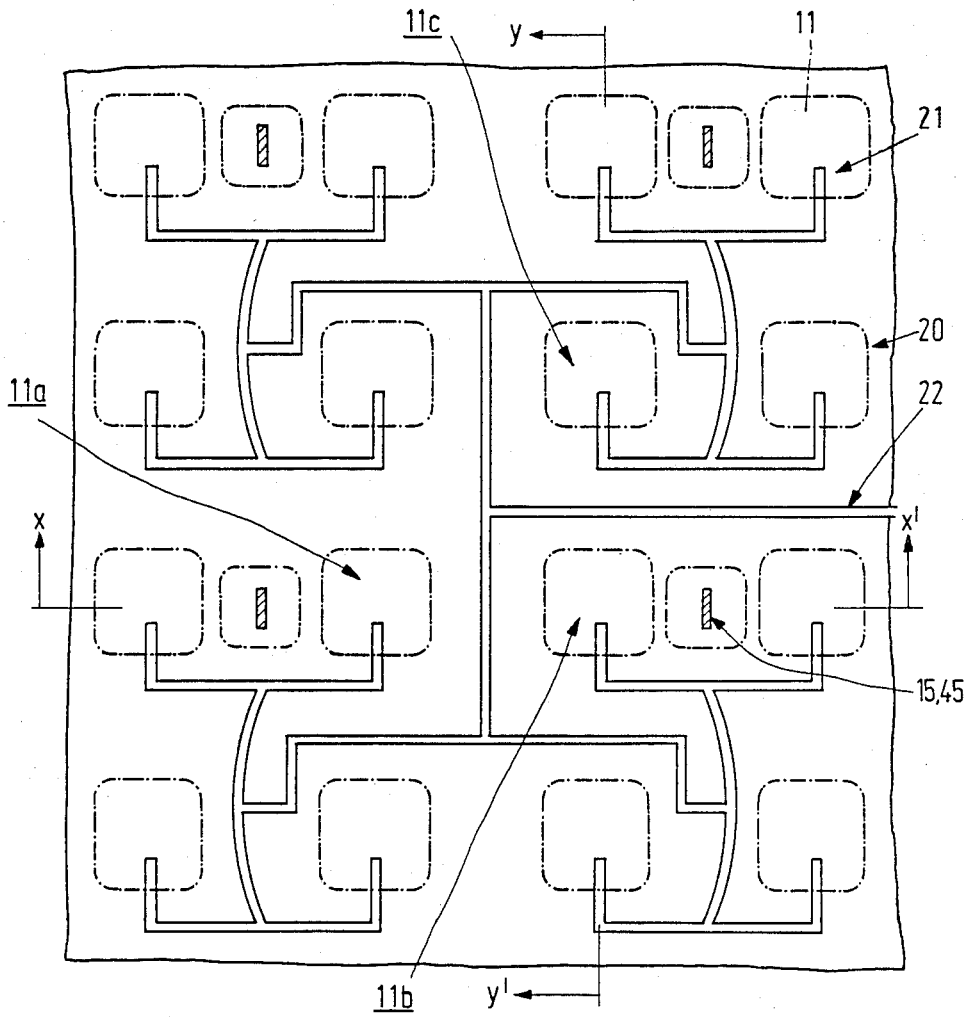
FIGS. 2*a* and 2*b* are top elevational views of portions of the two networks of strip conductors of the high-frequency lines of this antenna and show the axis XX' and YY' along which the cross-sectional views 1*a* and 1*b*, respectively are made.
Figure 2B:
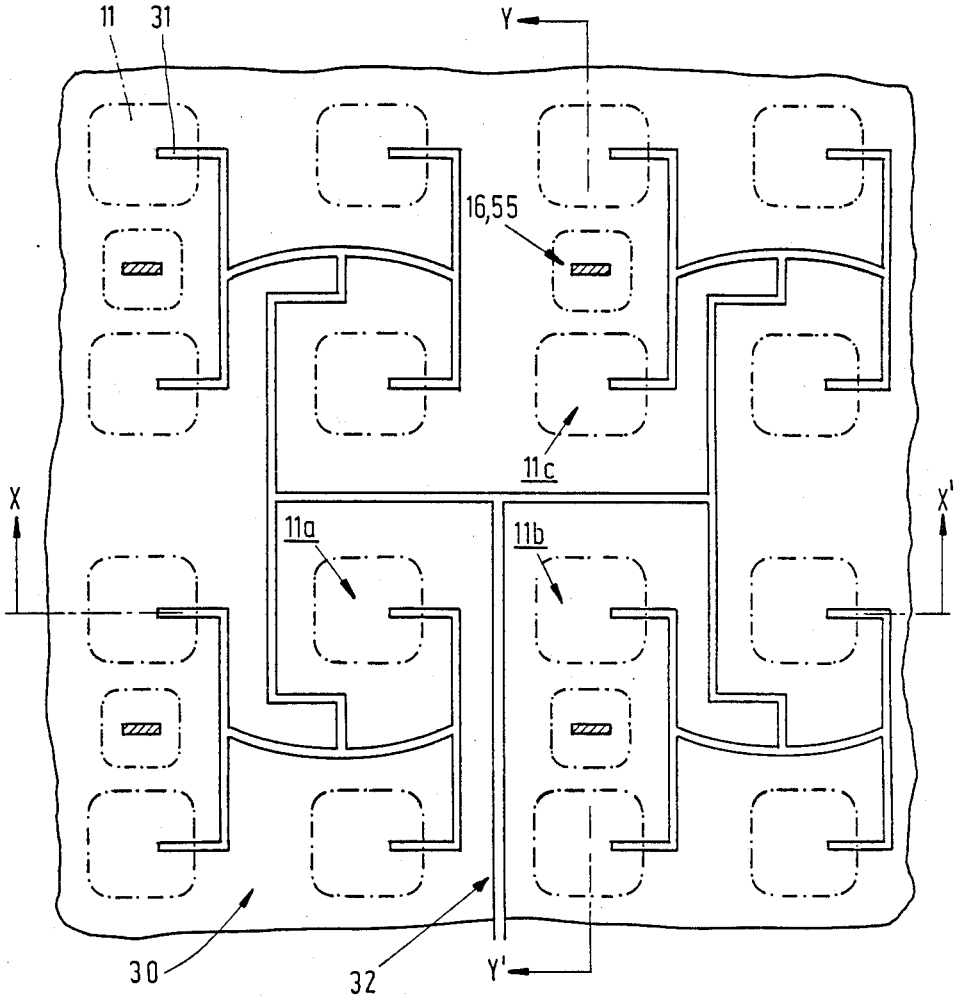

From the FIGS. 2*a* and 2*b*, which show respectively a portion of the dielectric sheet 20 and the dielectric sheet 30, the repetitive configuration of the antenna circuits provides empty spaces between the printed conductors 22 and 32 in such an adequately large number that the spacers ensure the rigidity of the assembly, although they are remote from each other.

FIGS. 2*a* and 2*b* show, in dashed lines, the printed conductors 22 and 32, the projections of the cavities 11, and the projections of the positioning spacers. Finally, FIGS. 2*a* and 2*b* show the axes XX' and YY' along which the sections shown in FIGS. 1*a* and 1*b*, respectively are made. The cavities 11*a*, 11*b* and 11*c* of the FIGS. 1*a* and 1*b* correspond to the cavities of FIGS. 2*a* and 2*b*, which are denoted by the same reference numerals.

In an improved version of the above-described embodiments, clips 60 are provided to align the spacers 15 and 45 on the one hand, and 16 and 55 on the other hand, and also circuits provided on the sheets 20 and 30, respectively. These clips prevent, inter alia, the different elements from being shifted relative to each other.

The improvement provided by the invention will be better understood from FIGS. 3 and 4.

Figure 3A:
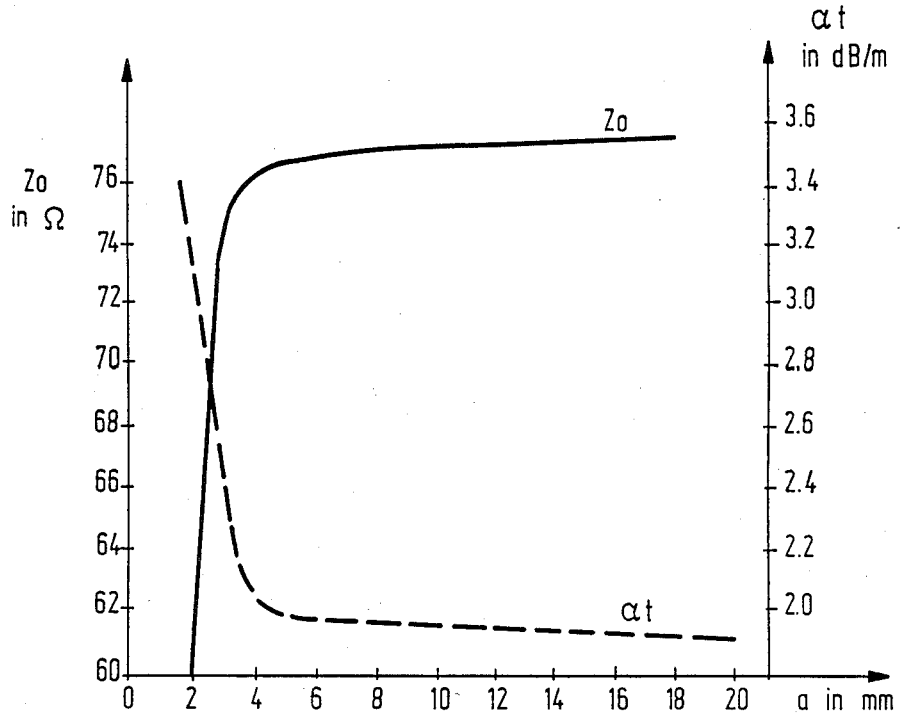
FIG. 3*a* shows (by means of a solid line) the curve along which the impedance $Z_o$ varies in ohms, of a coaxial line with a strip conductor formed by a suspended-substrate microstrip line, as a function of the width a in millimeters (mm) of the slot in which the strip conductor is provided.
Figure 3B:
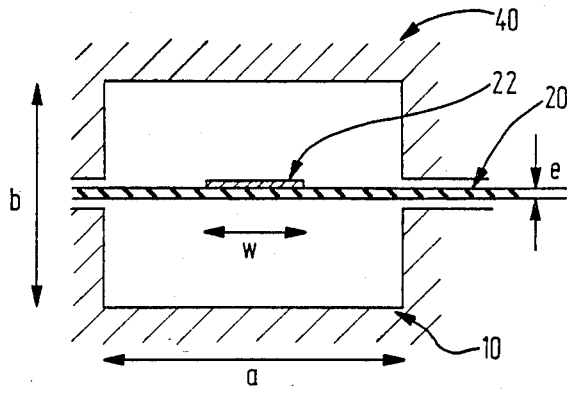
FIG. 3*b* is a cross-sectional view through a coaxial line having a strip conductor suspended in a slot of finite width.

The curves of FIG. 3*a* relate to a suspended-substrate microstrip line which is illustrated by FIG. 3*b* and for which the following conditions hold:

the frequency used $F=12.1$ GHz,
width of the copper conductor $W=1.4$ mm,
thickness of the dielectric $e=25$ $\mu$m,
the specific dielectric constant $\epsilon=3.2$,
the loss factor tan $\delta=0.02$,
depth of the line $b=1.8$ mm.

For these circumstances FIG. 3*a* shows that the total attenuation factor $\alpha_T$ in the lines decreases as a function of the width a of the slots in which the central conductors are disposed, to reach a low value which remains substantially constant when the value of a exceeds 6 mm.

FIG. 3*a* also shows that such a variation of the width a only causes an increase of approximately 10 Ohms in the impedance value $Z_o$ of the line, which is no disadvantage.

FIGS. 1*a* and 1*b* show that in the arrangement according to the invention the width a of the slots is equivalent to the spacing between two positioning spacers and may be considered as being very large compared with the width of the slots in accordance with the prior art (FIG. 3 of the above-mentioned patent application No. 82 18 700). Actually, at least two cavities or strip conductors of the network of strip conductors are positioned between at least two successive spacers. In these circumstances, the dielectric substrate being thin, the main dielectric is the air, and the high-frequency lines may be classed as a "microstrip line having the air as a dielectric", or as a "microstrip line with fully suspended substrate". The loss factors due to the width of the slots is minimal.

On the other hand, because the loses increase when the thickness of the dielectric substrate on which the strip conductors are provided increases (see FIG. 4*a*), it is desirable to keep the thickness small to prevent the losses from exceeding a permissible limit.

Figure 4A:
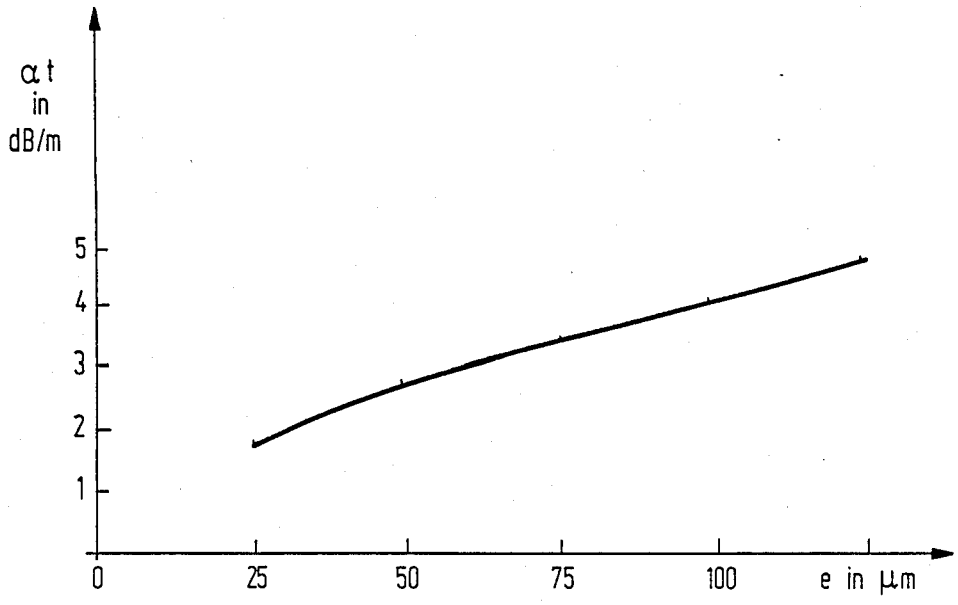
FIG. 4*a* shows the variation of the total attenuation factor $\alpha_T$ in decibels per meter (dB/m) as a function of the thickness e in μm of the dielectric substrate on which the printed circuit of strip conductors is provided.
Figure 4B:
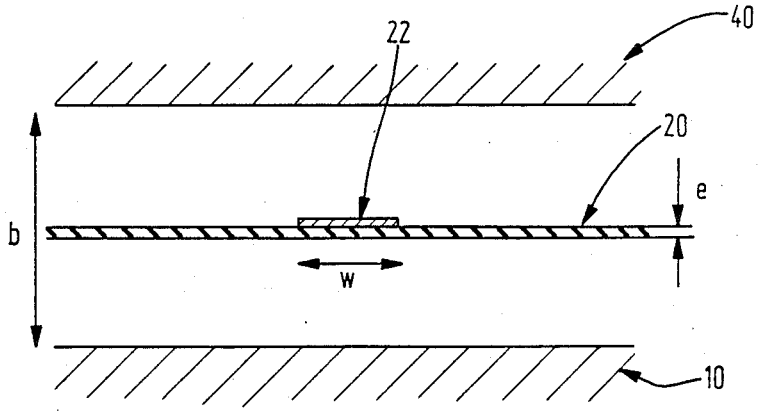
FIG. 4*b* is a cross-sectional view through a coaxial line having a strip conductor suspended in a slot of infinite width.

The curve in FIG. 4*a* illustrates the attenuation of a microstrip line with a fully suspended substrate as is shown in FIG. 4*b*, and for which the following conditions hold:

frequency used $F=12.1$ GHz,
width of the copper conductor $W=1.4$ mm,
dielectric constant $\epsilon=3.2$,
loss factor tan $\delta=0.02$,
depth of the line $b=2$ mm.

For an arrangement according to the invention in which the thickness of the substrate is between 50 and 100 $\mu$m, which is sufficient to ensure its rigidity, the losses due to the thickness of this substrate may also be assumed to be at a minimum.

Finally, calculations as well as measurements have shown that in an antenna whose network is shown in FIGS. 2*a* and 2*b*, the fact that the several branches of conductors are near to each other or the fact that certain branches are near to the cavities does not affect the results hoped for and does not reduce the anticipated improvement. Actually, this nearness corresponds to a large distance with respect to the width W of the strip conductors.

Because the losses in the dielectric and the losses in the conductors are rendered as low as possible, the efficiency of an antenna realized in accordance with the invention is improved.

The positioning spacers may be produced separately from the plates 10, 40 and 50, and provided thereon afterwards. More advantageously, they may alternatively be an integral part of the plates and be formed in one single machining operation, with less severe tolerances. The recurrent structure resulting from the respective configuration of the conductor circuits between which the spacers are placed ensures that the industrial production of components forming an antenna according to the invention is greatly simplified.

On the other hand, mounting the different elements with respect to each other is also rendered fast and easy, thanks to the alignment clips and the fact that the tolerances in the positioning of the elements are less severe.

Finally, because the losses in the lines are very low, it is possible to use for the substrate a dielectric of a standard quality, and thus of low cost, without reducing the efficiency of the antenna to a considerable extent.

Because of the simplicity of production and mounting the elements, and the low cost of the raw materials, the cost of an antenna according to the invention is considerably reduced.

Obviously, the present invention is not limited to an antenna having two arrays of high-frequency lines. If one wants to have a planar antenna intended to receive or transmit high-frequency signals of only one type of polarization, the antenna can be obtained on the basis of the antenna described in the foregoing by simply omitting the intermediate layer 10 and one of the two dielectric sheets 20 or 30 carrying one of the networks of strip conductors of the supply line.

Finally, it will be clear that the invention is not limited to the reception of 12 GHz television signals transmitted by satellites. The invention can be used with all types of purely ground-based high-frequency transmission networks. Also, the exemplary choice of the frequency of 12 GHz does not exclude use of other operating frequencies in the high-frequency range.

I claim:

1. A planar high-frequency antenna including at least two facing conductive plates having corresponding openings which cooperate to form respective cavities, and a relatively thin dielectric sheet disposed between the conductive plates and supporting an array of strip conductors which cooperate with the conductive plates to form suspended-substrate microstrip lines and which have ends extending into respective ones of the cavities, characterized in that the conductive plates are spaced from the dielectric sheet and the supported strip conductors by pairs of first and second spacers arranged on opposite sides of the dielectric sheet, each pair of spacers clamping the dielectric sheet therebetween in areas where no strip conductors are located, said pairs of spacers being sufficiently separated from each other such that at least two of said cavities and/or strip conductors are located between any two pairs.

2. An antenna as in claim 1 where each spacer is an integral part of the conductive plate which it spaces from the dielectric sheet.

3. An antenna as in claim 1 or 2 where the pairs of spacers are arranged at regular intervals.

4. An antenna as in claim 1 or 2 where the first and second spacers in at least one pair are joined together by a fastening clip provided to prevent shifting of the conductive plates relative to the dielectric sheet.

5. An antenna as in claim 1 or 2 where the thickness of the dielectric sheet is between 40 and 100 micrometers.

6. An antenna as in claim 1 or 2 comprising successive first, second and third conductive plates, and first and second dielectric sheets, said first dielectric sheet being disposed between said first and second conductive plates, and said second dielectric sheet being disposed between said second and third conductive plates.

7. An antenna as in claim 1 or 2 comprising at least one pair of dielectric sheets separated by a single conductive plate.

* * * * *